US008955737B2

(12) United States Patent
Stewart et al.

(10) Patent No.: US 8,955,737 B2
(45) Date of Patent: Feb. 17, 2015

(54) SPLIT CARTON

(75) Inventors: Noel G. Stewart, Cumming, GA (US); Simon Gainey, Media, PA (US)

(73) Assignee: The Coca-Cola Company, Atlanta, GA (US)

( * ) Notice: Subject to any disclaimer, the term of this patent is extended or adjusted under 35 U.S.C. 154(b) by 670 days.

(21) Appl. No.: 11/859,825

(22) Filed: Sep. 24, 2007

(65) Prior Publication Data

US 2008/0078820 A1 Apr. 3, 2008

Related U.S. Application Data

(60) Provisional application No. 60/827,730, filed on Oct. 2, 2006.

(51) Int. Cl.

| | |
|---|---|
| ***B65D 17/32*** | (2006.01) |
| ***B65D 5/52*** | (2006.01) |
| ***B65D 5/468*** | (2006.01) |
| *B65D 5/54* | (2006.01) |

(52) U.S. Cl.

CPC ..... *B65D 5/5253* (2013.01); *B65D 5/4608* (2013.01)

USPC ..... 229/243; 229/122

(58) Field of Classification Search

USPC ..... 229/243, 122, 235, 120.09, 120.011, 229/427; 206/427

See application file for complete search history.

(56) References Cited

U.S. PATENT DOCUMENTS

| | | | | |
|---|---|---|---|---|
| 1,656,919 | A | 1/1928 | Marsh | |
| 2,152,079 | A * | 3/1939 | Mott | 206/746 |
| 2,751,964 | A | 6/1956 | Guyer | |
| 2,967,610 | A * | 1/1961 | Ebert et al. | 206/494 |
| 3,002,613 | A * | 10/1961 | Merkel et al. | 206/193 |
| 3,043,490 | A | 7/1962 | Burnett | |
| 3,056,665 | A | 10/1962 | Linda et al. | |
| 3,215,332 | A * | 11/1965 | Bess | 229/240 |
| 3,620,439 | A | 11/1971 | Kulp | |
| 4,558,785 | A | 12/1985 | Gordon | |
| 4,773,541 | A | 9/1988 | Riddell | |
| 4,793,487 | A * | 12/1988 | Bentsen et al. | 206/451 |
| 4,981,253 | A | 1/1991 | Quaintance | |
| 5,098,757 | A | 3/1992 | Steel | |
| 5,464,151 | A | 11/1995 | Porker et al. | |
| D431,462 | S | 10/2000 | Menaged et al. | |
| 6,976,588 | B2 | 12/2005 | Wischusen et al. | |
| 7,284,662 | B2 * | 10/2007 | DeBusk et al. | 206/745 |
| 7,373,765 | B2 * | 5/2008 | Welchel et al. | 53/492 |
| 7,743,944 | B2 * | 6/2010 | Ho Fung et al. | 221/305 |
| 7,784,675 | B2 * | 8/2010 | Sutherland et al. | 229/240 |
| 7,988,034 | B2 | 8/2011 | Pezzoli | |
| 2005/0263578 | A1 | 12/2005 | Wang | |
| 2006/0054522 | A1 | 3/2006 | Stewart | |

(Continued)

FOREIGN PATENT DOCUMENTS

| | | | |
|---|---|---|---|
| DE | 29611809 | U1 | 7/1996 |
| WO | 2005/110866 | A1 | 11/2005 |

*Primary Examiner* — Justin Larson
*Assistant Examiner* — Phillip Schmidt
(74) *Attorney, Agent, or Firm* — Sutherland Asbill & Brennan LLP

(57) ABSTRACT

A carton. The carton may include a top wall, a bottom wall, a first side wall, a second side wall, a first tear line positioned about a middle of the first side wall, and a second tear line positioned about a middle of the second side wall.

14 Claims, 4 Drawing Sheets

(56) References Cited

U.S. PATENT DOCUMENTS

| | | | |
|---|---|---|---|
| 2006/0065703 | A1 | 3/2006 | DeBusk et al. |
| 2006/0081692 | A1 | 4/2006 | Stewart |
| 2006/0108406 | A1 | 5/2006 | Stewart |
| 2006/0118606 | A1 | 6/2006 | Holly et al. |
| 2007/0090175 | A1* | 4/2007 | Schemmel ..... 229/242 |
| 2007/0131749 | A1* | 6/2007 | Coltri-Johnson et al. . 229/122.1 |
| 2008/0245850 | A1 | 10/2008 | Spivey |
| 2011/0198366 | A1 | 8/2011 | Spivey |

* cited by examiner

SPLIT CARTON

TECHNICAL FIELD

The present application relates generally to a carton and more particularly relates to a carton with a middle perforation such that the carton may be split in half for ease in dispensing the articles therein.

BACKGROUND OF THE INVENTION

Various types of cartons are known for enclosing various types of articles, such as cans, bottles, and other objects. One recent type of container is known as the "FRIDGE PACK™" carton. For example, various types of "FRIDGE PACK™" cartons are produced for and sold to bottlers under license with The Coca-Cola Company of Atlanta, Ga. for the sale of Coca-Cola® brand products and similar items.

The "FRIDGE PACK™" cartons generally have a two by six (2×6) product shape, with two (2) product columns in height and six (6) product rows in length. One end of the carton generally is scored so as to permit the removal of a dispenser section such that a consumer can grasp the products therein. The design of two (2) columns and six (6) rows with the removable dispenser section generally promotes the use of the carton within a standard refrigerator. Other configurations, however, such as two (2) rows of four (4) cans each (eight pack) and three (3) rows of four (4) cans each ("three by four twelve pack") also are possible and within the scope of the present application.

Although the "FRIDGE PACK™" cartons are popular and convenient when placing the carton lengthwise on a refrigerator shelf, the dispenser section is not always well positioned if a consumer desires, for example, to place the carton in a refrigerator door shelf or elsewhere. The consumer may have to move the carton so as to access the dispenser section and remove an article. There is a desire, therefore, for a carton that provides even more versatility than can be found with known "FRIDGE PACK™" cartons and similar types of designs.

SUMMARY OF THE INVENTION

The present application thus describes a carton. The carton may include a top wall, a bottom wall, a first side wall, a second side wall, a first tear line positioned about a middle of the first side wall, and a second tear line positioned about a middle of the second side wall.

The top wall may include a handle cutout. The top wall may include a top tear line intersecting the handle cutout. The bottom wall may include a fold line intersecting the first tear line and the second tear line. The first tear line and the second tear line may include a curvilinear shape.

The carton further may include a number of articles positioned therein. The articles may include two (2) columns and six (6) rows. The carton further may include a dispenser section positioned on one end thereof. The middle of the first side wall and the middle of the second side wall may include a position between a third row and a fourth row of the number of articles or between a second row and a third row. The dispenser section extends along a front wall and the second side wall. The dispenser section may include a curvilinear shape about the front wall.

The present application further describes a blank for erecting a carton. The blank may include a top panel with a handle cutout, a bottom panel, a pair of side panels, and a pair of tear lines extending along a middle of each of the side panels and intersecting the handle cutout on the top panel.

The bottom panel may include a fold line intersecting the tear lines. The tear lines may include a number of curvilinear tear lines. The blank further may include a number of dispensing tear lines. The first side panel may include a dispensing flap, the top panel may include a first reinforcing flap, and the bottom panel may include a second reinforcing flap. The dispensing tear lines may include the dispensing flap, the first reinforcing flap, the second reinforcing flap, and the second side wall. The dispensing flap may include a curvilinear tear line.

The present application further describes a method of opening a carton. The method may include the steps of carrying the carton via a handle positioned along a top wall, grasping the carton along the top wall and a pair of side walls, and tearing a number of tear lines positioned about the top wall and the pair of side walls. The tearing step may include twisting the carton. The tearing step also may include applying pressure to one or more ends of the carton. The method further may include the step of bending the carton into two ends.

The present application further describes a carton. The carton may include a top wall, a handle cutout positioned within the top wall, a bottom wall, a pair of side walls, and a tear line extending from the handle cutout and along the pair of side walls. The bottom wall may include a fold line intersecting the tear line. The tear line may include a curvilinear shape.

These and other features of the present application will become apparent to one of ordinary skill in the art upon review of the following detailed description when taken in conjunction with the several drawings and the appended claims.

DETAILED DESCRIPTION

Figure 1:
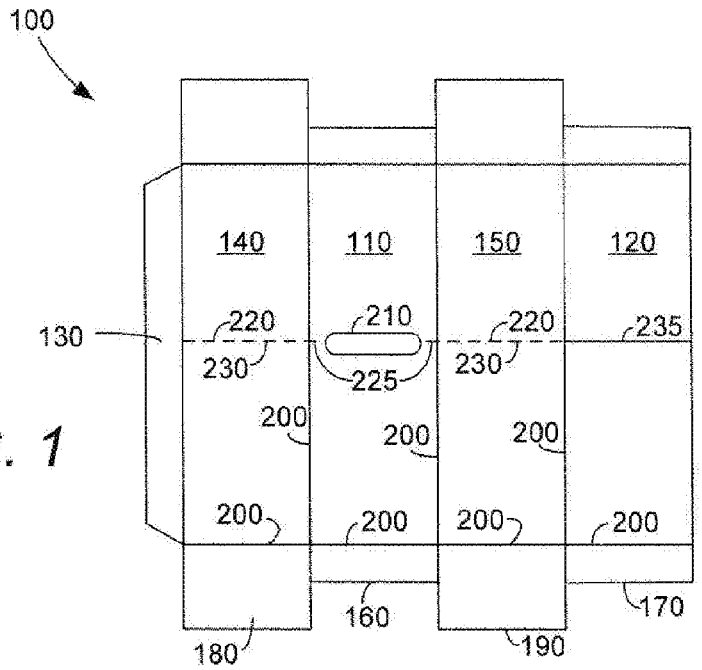
FIG. 1 is a plan view of a carton blank as is described herein.

Referring now to the drawings in which like numerals indicate like elements throughout the several views, FIG. 1 shows a blank 100 that may be used to erect a carton as is described herein. The blank 100 may be made out of cardboard, paperboard, corrugated board, or other types of foldable sheet materials. Specifically, the blank 100 may be made out of coated unbleached paperboard. The blank 100 may be die cut from a continuous sheet of material or from individual sheets. Other construction techniques may be used herein.

Each blank 100 may have a number of fold lines and tear lines formed therein. The term "fold line" may refer to a weakened line that facilitates folding of the material along the length of the line. The fold line may include, but is not limited to, a score line, a perforation, a line of short slits, a line of half-cuts, a combination of slits and score lines, and similar arrangements. Any reference to a fold line or any type of hinged connection should not be construed as being limited to a single fold line. Any such fold line or hinged connection may be formed from one or more fold lines.

The term "tear" line may refer to a line of severance or any other type of weakened line that facilitates tearing or separation along the length of the weakened line. The tear line may include, but is not limited to, a perforation, a line of short slits, a line of half-cuts, a combination of slits and score lines, and similar arrangements.

The blank 100 may have a number of panels and flaps separated by the fold lines. Specifically, the blank 100 may have a top panel 110, a bottom panel 120, a bottom flap 130, and a pair of side panels, a first side panel 140, and a second side panel 150. The top panel 110 and the bottom panel 120 each may have a reinforcing flap positioned adjacent thereto, a top reinforcing flap 160 and a bottom reinforcing flap 170. The first side panel 140 and the second side panel 150 each may have a dispensing flap positioned thereto, a first dispensing flap 180 and a second dispensing flap 190. The other side of the blank 100 may have similar flaps. The respective panels and flaps may be connected by a number of fold lines 200. Other shapes may be used herein.

The top panel 110 may have a handle cutout 210 formed approximately in the lengthwise middle thereof. A middle tear line 220 may extend from both sides of the handle cutout 210 across the width of the top panel 110 and then down across the width of the side panels 140, 150. The middle tear line 220 may include a pair of top tear lines 225 on either side of the handle cutout 210 and a pair of side tear lines 230 on the side panels 140, 150. Alternatively, the handle cutout 210 may extend across the width of the top panel 110 and intersect with the side tear lines 230. A bottom fold line 235 may extend across the width of the bottom panel 120 and intersect the middle tear lines 220 on both side panels 140, 150. Alternatively, a bottom tear line also may be used herein. Other shapes may be used herein.

Figure 2:
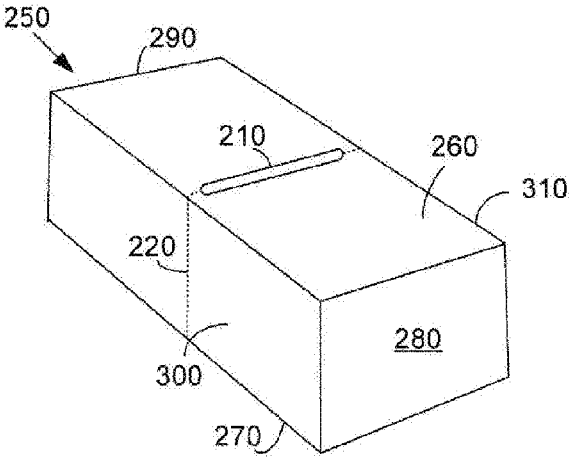
FIG. 2 is a perspective view of a carton erected from the blank of FIG. 1.
Figure 2A:
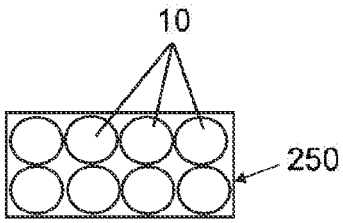
FIG. 2A is a side cross-sectional view of the carton of FIG. 2.

The blank 100 may be used to erect a carton 250 as is described herein. As is shown in FIG. 2, the carton 250 may have a top wall 260, a bottom wall 270, a front wall 280, a back wall 290, a first side wall 300, and a second sidewall 310. The carton 250 may be erected by attaching the bottom panel 120 and the bottom flap 130, folding the reinforcing flaps 160, 170 and attaching the dispensing flaps 180, 190 to each other and/or to the reinforcing flaps 160, 170. A conventional adhesive or other type of joinder means may be used herein.

The carton 250 may be filled with a number of articles 10. The articles 10 may be cans, bottles, or other types of goods that may be positioned within the carton 250. In this example, the carton 250 has two (2) product columns in height and six (6) product rows in length for a total of twelve (12) articles 10. Other configurations may be used herein.

Figure 3:
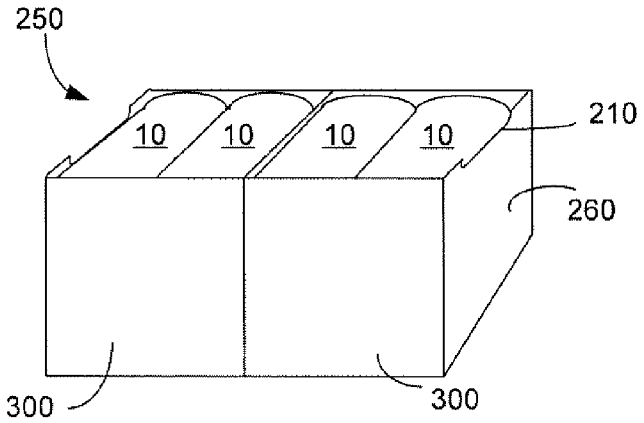
FIG. 3 is a perspective view of the carton of FIG. 2 as folded in half.

In use, the carton 250 may be carried via the handle cutout 210. The carton 250 then may be opened in a conventional manner about the back wall 270 or the front wall 280. Specifically, a conventional dispenser section may be used herein. Alternatively, the middle tear line 220 may be torn and the carton 250 may be folded in half upon the bottom fold line 235. As is shown in FIG. 3, the carton 250 then may rest on the front wall 280 and the back wall 290 thereby leaving the articles 10 in easy reach. As shown, four articles 10 are available.

The middle tear line 220 may be torn or burst by grasping the carton 250 across the top wall 260 and along the side walls 300, 310 and "twisting" each half of the carton in the opposite direction the carton 250 until the middle tear line 220 is torn. Alternatively, one-half of the carton 250 may be placed on a ledge and pressure may be applied to the unsupported end of the carton 250 such that the carton 250 folds along the bottom fold line 235. Bending the carton 250 also may tear the middle tear lines 220. Other types of opening means may be used herein.

Figure 4:
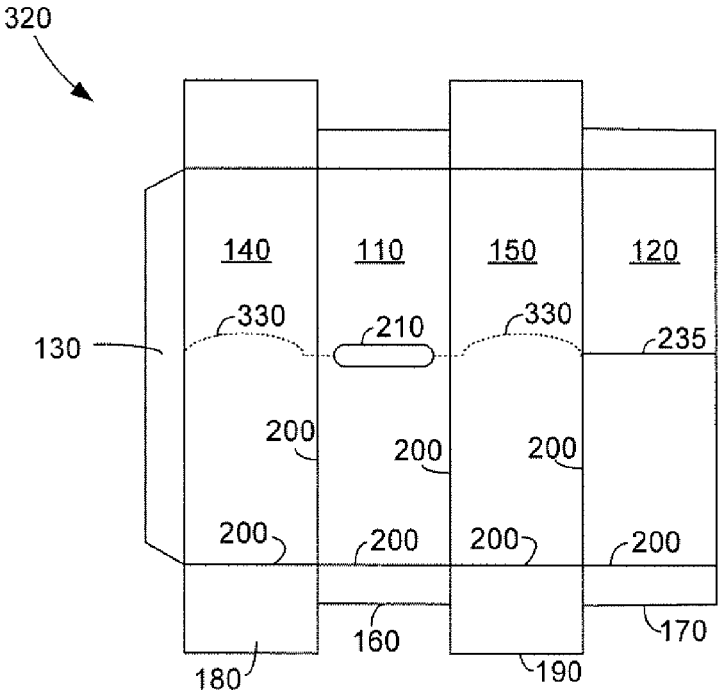
FIG. 4 is a plan view of an alternative blank as is described herein.
Figure 5:
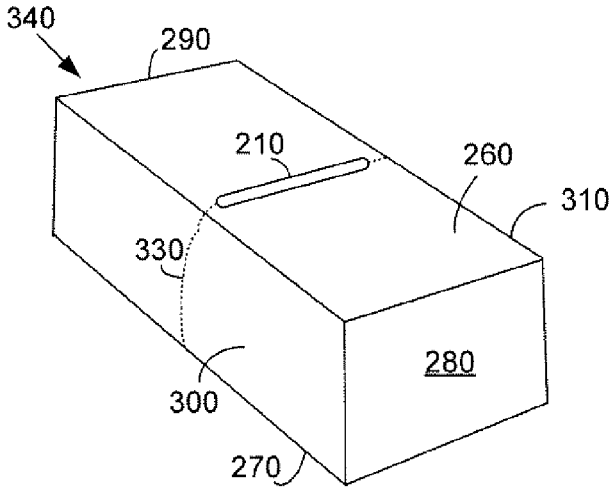
FIG. 5 is a perspective view of a carton erected from the blank of FIG. 4.

FIG. 4 shows an alternative blank 320 as is described herein. The blank 320 is largely identical to the blank 100 described above except that it has a curvilinear tear line 330 that extends along the side panels 140, 150. In this example, the curvilinear tear line 330 may take the shape of, for example, the famous "Dynamic Ribbon" trademark of The Coca-Cola Company of Atlanta, Ga. Any desired shape, however, may be used herein. FIG. 5 shows a carton 340 erected according to the blank 320. As is shown, the curvilinear tear line 330 extends across the side walls 300, 310.

Figure 6:
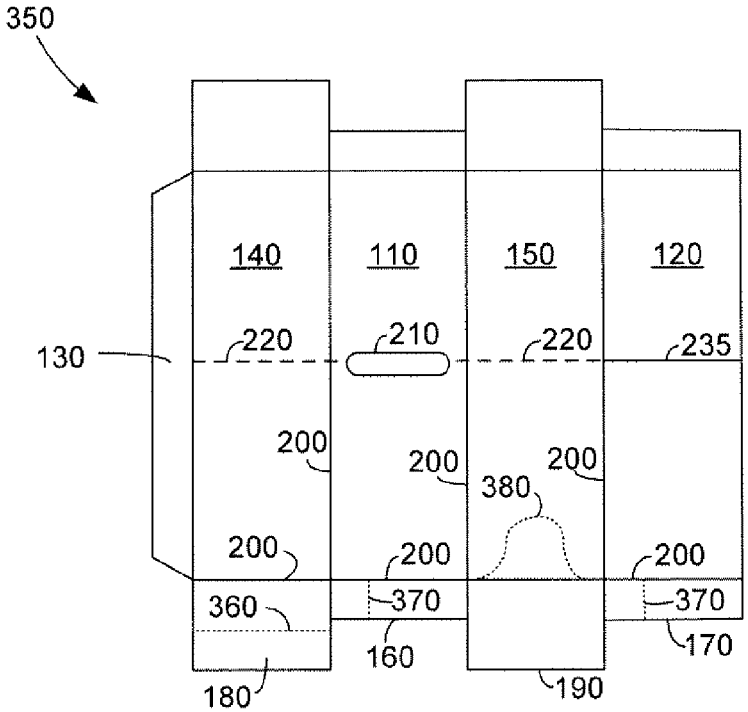
FIG. 6 is a plan view of an alternative blank as is described herein.

FIG. 6 shows an alternative blank 350 as is described herein. The blank 350 may be largely identical to the blank 100 described above but with a number of additional tear lines so as to form a dispenser section as will be described in more detail below. For example, the first dispensing flap 180 may include a dispensing flap tear line 360. The dispensing flap tear line 360 may bisect the dispensing flap 180 along the width of the flap 180. Each reinforcing flap 160, 170 also may have a reinforcing flap tear line 370 extending along the shorter dimension of the flaps 160, 170. Finally, the second side panel 150 may have a side wall tear line 380 formed therein. The side wall tear line 380 may extend into the second side panel 150. Although a curved shape is shown, any shape may be used herein. Any other type of dispenser section may be used herein.

Figure 7:
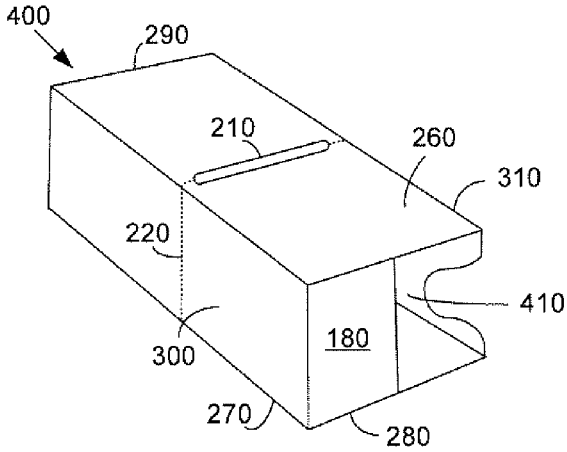
FIG. 7 is a perspective view of a carton erected from the blank of FIG. 6.

FIG. 7 shows a carton 400 erected from the blank 350. As is shown, the carton 400 has a dispenser section 410. The dispenser section 410 may be formed via the tear lines 360, 370, 380 described above and is formed along the front wall 280 and the second side wall 310. The dispenser section 410 may be used with the middle tear line 220 as described above. Any other type of dispenser section 410 also may be used herein.

Figure 8:
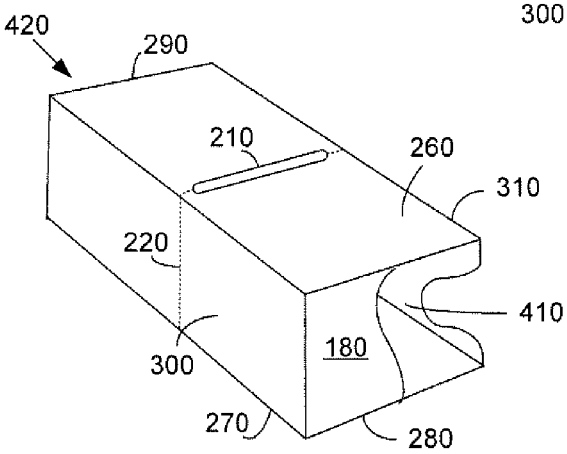
FIG. 8 is a perspective view of an alternative carton as is described herein.

FIG. 8 shows an alternative embodiment of a carton 420. The carton 420 is largely identical to the carton 400 described above but with the remaining portion of the front wall 280 taking a curvilinear shape. In this case, the shape may be similar to the famous "Dynamic Ribbon" trademark of The Coca-Cola Company of Atlanta, Ga. The curvilinear shape may be formed along the first dispenser flap 180. Any other shape may be used herein.

Any type of dispenser 410 may be used with the tear line 220. Examples of other types of dispenser 400 are shown in commonly owned U.S. patent application Ser. No. 10/709,774, filed on May 24, 2004, entitled "CARTON"; U.S. patent application Ser. No. 11/162,541, filed on Sep. 14, 2005, entitled "CARTON WITH ARTICLE OPENING"; U.S. patent application Ser. No. 11/162,542, filed on Sep. 14, 2005, entitled "CARTON WITH ARTICLE OPENING"; and U.S. patent application Ser. No. 11/162,543, filed on Sep. 14, 2005, entitled "CARTON WITH ARTICLE OPENING." Each of these applications is incorporated by reference.

Figure 9:
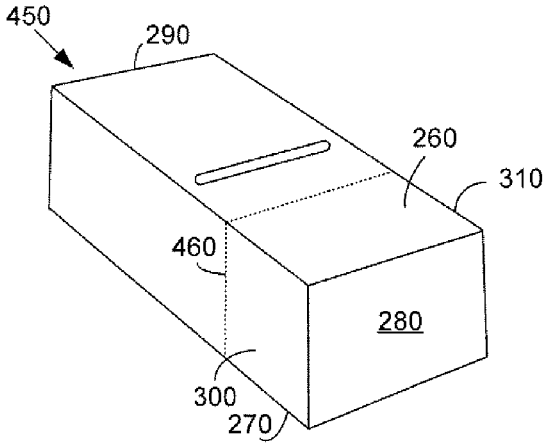
FIG. 9 is a perspective view of an alternative carton as is described herein.

FIG. 9 shows an alternative embodiment of a carton 450. The carton 450 is largely identical to the carton 250 described above (as well as the blank 100) but with a middle tear line 460 positioned between the second and third row of articles 10 (from the front wall 280) as opposed in the middle along the handle cutout 210. As such, the carton 450 has eight (8) articles 10 on one side and four (4) on the other. The middle tear line 460 may take any position along the top wall 260.

Although the terms "top", "bottom", and "side" are used herein, these terms simply imply a relative position with respect to the other walls and panels. In other words, any wall may be the "top" wall depending upon how the carton is positioned.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A carton, comprising:

a top wall comprising at least one top tear line positioned about a middle of the top wall;

a bottom wall;

a first side wall;

a second side wall;

a first tear line positioned about a middle of the first side wall; and a second tear line positioned about a middle of the second side wall;

wherein the first tear line and the second tear line comprise a curvilinear shape; and the bottom wall comprises a fold line intersecting the first tear line and the second tear line at the curvilinear shape of the first tear line and at the curvilinear shape of the second tear line; and the at least one top tear line intersects at least one of the curvilinear shape of the first tear line or the curvilinear shape of the second tear line.

2. The carton of claim 1, wherein the top wall comprises a handle cutout.

3. The carton of claim 2, wherein the top wall comprises a top tear line intersecting the handle cutout.

4. The carton of claim 1, further comprising a plurality of articles positioned therein.

5. The carton of claim 4, wherein the plurality of articles comprises two (2) columns and six (6) rows.

6. The carton of claim 5, wherein the middle of the first side wall and the middle of the second side wall comprise a position between a third row and a fourth row of the plurality of articles.

7. The carton of claim 5, wherein the middle of the first side wall and the middle of the second side wall comprise a position between a second row and a third row of the plurality of articles.

8. The carton of claim 1, further comprises a dispenser section positioned on one end thereof.

9. The carton of claim 8, wherein the dispenser section extends about a front wall and the second side wall.

10. The carton of claim 9, wherein the dispenser section comprises a curvilinear shape about the front wall.

11. A blank for erecting a carton, comprising:

a top panel;

the top panel comprising a handle cutout;

a bottom panel;

a pair of side panels;

a pair of tear lines extending from the top panel to the bottom panel along a middle of each of the pair of side panels and intersecting the handle cutout on the top panel; and a plurality of dispensing tear lines;

wherein the first side panel comprises a dispensing flap, wherein the top panel comprises a first reinforcing flap, and wherein the bottom panel comprises a second reinforcing flap and wherein the plurality of dispensing tear lines defines the dispensing flap, a portion of the first reinforcing flap, and a portion of the second reinforcing flap; and the pair of tear lines comprises a plurality of curvilinear tear lines.

12. The blank of claim 11, wherein the bottom panel comprises a fold line intersecting the pair of tear lines.

13. The blank of claim 11, wherein the dispensing flap comprises a curvilinear tear line.

14. A carton, comprising:

a top wall;

a handle cutout positioned within the top wall;

a bottom wall;

a pair of side walls;

a tear line extending from the handle cutout to the bottom wall and along the pair of side walls;

the tear line comprises a curvilinear ribbon shape; and the bottom wall comprises a fold line intersecting the tear line.

* * * * *